United States Patent [19]

Bardin

[11] 4,301,727

[45] Nov. 24, 1981

[54] METAL PLATED PLASTIC BASE INTAGLIO PRINTING CYLINDERS & PLATES AND METHOD OF MANUFACTURE

[76] Inventor: Karl D. Bardin, 3754 Marianna Rd., Jacksonville, Fla. 32223

[21] Appl. No.: 108,454

[22] Filed: Dec. 31, 1979

Related U.S. Application Data

[63] Continuation-in-part of Ser. No. 846,105, Oct. 27, 1977, Pat. No. 4,197,798, which is a continuation-in-part of Ser. No. 620,550, Oct. 8, 1975, abandoned.

[51] Int. Cl.[3] ..... B41M 1/10

[52] U.S. Cl. ..... 101/170; 101/153; 101/401.1; 430/307

[58] Field of Search ..... 101/150, 170, 395, 401.1, 101/458, 459, 153, 454, 45, 163; 430/307

[56] References Cited

U.S. PATENT DOCUMENTS

| | | | |
|---|---|---|---|
| 3,015,268 | 1/1962 | Garrett | 101/395 X |
| 3,319,564 | 5/1967 | Goffredo | 101/401.1 |
| 3,361,063 | 1/1968 | Thorpe et al. | 101/401.1 X |
| 3,377,949 | 4/1968 | Prince | 101/395 X |
| 3,447,460 | 6/1969 | Vincent et al. | 101/395 X |
| 3,615,442 | 10/1971 | Geris et al. | 101/459 |
| 3,903,794 | 9/1975 | Grupe et al. | 101/401.1 X |
| 3,931,762 | 1/1976 | Furushima et al. | 101/401.1 |
| 4,078,031 | 3/1978 | Bishop | 101/401.1 X |
| 4,136,615 | 1/1979 | Pozniak | 101/401.1 |

OTHER PUBLICATIONS

"Direct or Reverse Printing Plate & Method & Use", IBM Tech. Discl. Bulletin, vol. 12, No. 7, Dec. 1969, p. 1022.

*Primary Examiner*—E. H. Eickholt
*Attorney, Agent, or Firm*—F. Eugene Davis, IV

[57] ABSTRACT

By providing a molded or extruded plastic base cylinder or plate with a surface coating of an etchable metal, a low cost printing media is achieved for use in intaglio or gravure printing. The plastic base cylinder may be machined to a low tolerance diameter before being substantially uniformly plated with an etchable metal such as copper or nickel about its entire outer peripheral surface, thereby assuring uniform balance and concentricity. The plated surface is then engraved or etched with the information to be printed, resulting in a low cost printing cylinder for use in intaglio or rotogravure printing. In one embodiment, the cylinder incorporates a substantially uniform diameter shafting bore along its central axis in order to provide for mounting the cylinder on a shaft or other fixture, while another embodiment provides for accurately disposed and engaging lugs which rotationally drive the cylinder. In this way, uniform pressure resistance and complete peripheral surface concentricity and balance is achieved during the printing, engraving, plating, and polishing processes. Preferably, the plastic base comprises polypropylene, which may incorporate various fillers or resins for improving the plastic's physical characteristics.

19 Claims, 10 Drawing Figures

METAL PLATED PLASTIC BASE INTAGLIO PRINTING CYLINDERS & PLATES AND METHOD OF MANUFACTURE

RELATED APPLICATIONS

This Application is a continuation-in-part of my copending U.S. Patent Application filed Oct. 27, 1977 and bearing Ser. No. 846,105 now U.S. Pat. No. 4,197,798 which was a continuation-in-part of my U.S. Patent Application filed Oct. 8, 1975 as Ser. No. 620,550 now abandoned.

BACKGROUND OF THE INVENTION

This invention relates to intaglio and gravure printing cylinders and plates, and more particularly to low cost, plastic based, metal surface cylinders and plates and the manufacture thereof.

Generally, intaglio or rotogravure printing is obtained from cylinders mounted to rotate about their central axis with the outer peripheral surface of the cylinder having been etched with the particular information to be printed.

The prior art cylinders generally comprise an outer peripheral layer of copper which when ground and polished to the exact desired diameter is then etched in order to carry the particular information to be printed.

The prior art cylinders themselves generally comprise seamless tubing of steel or iron which has been cut to length and counterbored at its ends for the receipt of mounting gudgeons. The gudgeons are secured to the tubing in a variety of methods, such as welding, botling, etc. with shafts extending from the center of the gudgeons in order to mount the resulting cylindrical drum. The cylinder with the gudgeons and shaft is then mounted in a plating tank so that the entire outer peripheral surface of the cylinder is plated.

Once the plating process is completed, the copper surface is polished until the exact diameter required in the printing machine is obtained. Then, the image transfer ready cylinder is engraved or etched by one of a variety of well known methods, thereby embedding the desired information into the cylindrical surface. Finally, the cylinder is mounted in the rotogravure printing apparatus and printing is initiated.

The rotogravure printing process has long been known as a process having low waste, flexibility and unexcelled quality in the resulting print. However, in spite of these inherent qualities in the rotogravure and intaglio printing methods, this process has only been employed generally for long run production, because of the extremely high cost for the production of cylindrical bases.

One of the inherent features of the rotogravure printing process is its ability to print a complete 360 degrees while also being able to product an infinitely variable repeat of information, within the capabilities of the machinery, onto a roll of paper without any mismatch or registry problem, since the cylinder can be etched about its entire periphery if so required by the design. As a result, the rotogravure printing process is presently employed in the production of wallpaper, wrapping paper, printed boxes, package wrappers, as well as catalogues and magazines (as examples of publication and commercial printing applications), and other similar long run continuous patterned printed product lines where large rolls of paper or substrate can be continuously printed without interruption. Furthermore, it has only been economically feasible for such type of product lines to employ rotogravure printing since the high cost of tooling and setup can be amortized over the length of the run.

Aside from the difficulty and the expense of setting up present rotogravure cylinders, the prior art cylinders suffer from the inherent difficulty of having only firm contact with the rotation-inducing shaft at the ends of the cylinder where the gudgeons are mounted. Since the information to be printed is engraved or etched in the cylinder's surface, tonal variations of the ink density can be achieved by varying the depth of the etch as well as the area of the etch. As a result, considerable pressure is exerted by the impression roller against the etched surface of the printing cylinder in order to force the paper passing between them down into the etched depressions in the cylinder's surface, thereby receiving these tonal variations.

Due to this extreme pressure, the prior art cylinders have difficulty with the etched surface not coming into complete contact with the paper. This failure is generally due to internal bending of the cylinder against the pressure of the rollers or imperfect concentricity of the surface. As a result of the deflection and concentricity problems, any desired increasing of the effective length of a cylinder creates complex engineering problems. In some applications, solid steel drums have been employed to reduce the deflection problem, however such cylinders are obviously very expensive and extremely difficult to handle, as well as being very difficult to be made perfectly concentric to its central axis about the entire contact surface.

Another problem inherently found in prior art rotogravure cylinders is the difficulty of maintaining a high degree of balance throughout the cylinder as the cylinder rapidly rotates. The typical construction of prior art cylinders with end mounted gudgeons driving either a tubular structured cylinder or a solid, heavy metal mass, creates an intrinsically unbalanced cylinder. Since one major advantage of rotogravure printing is its high speed, any detectable cylinder unbalance, no matter how slight, will create an increasing problem, first with tonal variations and eventually with system breakdown.

Although prior art cylinders have been constructed with increasing tolerance levels being maintained, the basic structure of these prior art units prevents complete elimination of balance problems. In the first class of prior art cylinders, a solid heavy mass of metal is employed as the base. In this construction, balance can be minimized by extremely expensive machining procedures. However, since completely perfect balance is not economically feasible, the balance imperfections, however minor initially, become increasingly pronounced due to the unequal centrifugal pull exerted by this massive, heavy structure.

The other general class of prior art cylinders is tubular structured. These cylinders are inherently unbalanced, since insufficient internal rigidity is employed or gudgeon-like driving systems are used which are incapable of commercially feasible perfect balance.

The best known prior art are the references cited by the Examiner in my above-identified parent Application. However, these references are not believed to in any way teach or suggest the present invention. Although an extensive list of references were cited by the Examiner, the following are believed to be the most pertinent references:

| | | |
|---|---|---|
| Ballard | U.S. Pat. No. | 1,643,046 |
| Koch | French Patent | 1,289,119 |
| Hunn | U.S. Pat. No. | 2,872,349 |
| Trzyna | U.S. Pat. No. | 3,693,544 |
| Barker | U.S. Pat. No. | 3,832,948 |

Ballard discloses the typical prior art rotogravure cylinders which employ solid metal cylindrical bases, or thick walled metal cylindrical shells, with the etchable metal affixed thereto.

In Koch, merely a plastic gravure plate and method of manufacturing thereof is disclosed. Koch shows in FIG. 4, a hollow, cylindrically-shaped multi-layered plastic construction, however, there is absolutely no teaching or suggestion as to the construction of the supportive base on which this hollow, cylindrical shell will be mounted and driven. Furthermore, the disclosure relating to FIG. 4 clearly shows that element 17 is an elongated electric lamp which extends along the axis of the hollow cylinder and is used to expose the gelatin layers forming the plate construction, in order to develop the layers in accordance with the disclosed process. There is no teaching or suggestion of any kind in Koch which in any way teaches a complete operative rotogravure printing cylinder or image-ready cylinder.

Similarly, both Trzyna and Hunn do not disclose an isotonic and isotropic plastic base construction which is capable of meeting the standards and criteria for an operative rotogravure printing cylinder. In Trzyna, the cylindrical core material was formed in place while Hunn discloses a carveable plastic cylinder for making a relief-type surface. Neither disclosure is capable of teaching a cylindrically-shaped molded plastic supportive base capable of performing as a base of a rotogravure printing cylinder.

In Barker, a flat plastic supporting base is taught which is directly etched in order to provide a printing master. This is completely divergent from the teaching of the present invention wherein plastic is employed as a supporting base only and is not directly etched. Furthermore, the plastic base of the present invention is surrounded with an etchable metal into which the printing information is etched.

None of the best known prior art references in any way teaches or suggests a lightweight molded plastic supportive base for an operative gravure or intaglio printing system, as defined in the present application, with its isotonic, isotropic, stress and void-free inherent characteristics as detailed in this present disclosure. These prior art references merely typify the problems, discussed in detail above, that have constantly faced the gravure printing field and have heretofore gone unresolved.

In the prior art gravure plates, the first generation or original plate is produced in a solid sheet of pure copper having a thickness ranging generally between 0.020 and 0.125 inches, and consequently, are heavy and expensive. Due to the high cost of investment required for a gravure plate to be etched or engraved, there is a complete lack in the industry of an image ready transfer gravure plate which could be maintained as a stock item ready for direct engraving and immediate use.

Objects of the Invention

Therefore, it is a principal object of this invention to provide gravure or intaglio printing cylinders and plates which are lightweight and inexpensive.

Another object of this invention is to provide rotogravure or intaglio printing cylinders having the characteristic features defined above which are perfectly balanced and uniformly concentric.

Another object of this invention is to provide rotogravure or intaglio printing cylinders having the characteristics defined above, which resist bending during the printing process at every point about the periphery of the cylinders.

Another object of the invention is to provide rotogravure or intaglio printing cylinders having the characteristics defined above which are easily handled during assembly in the printing equipment.

A further object of the invention is to provide rotogravure or intaglio printing cylinders having the characteristics defined above which can be manufactured in any desired length and can accommodate any diameter rotation-inducing shaft.

Another object of this invention is to provide gravure or intaglio printing cylinders having the characteristic features defined above which accommodate end-mounted driving means which eliminates the use of gudgeons.

Another object of this invention is to provide gravure or intaglio printing plates which can be maintained as a stock item ready for direct engraving or etching and immediate use when required.

Other and more specific objects will in part be obvious and will in part appear hereafter.

SUMMARY OF THE INVENTION

The rotogravure or intaglio printing cylinder of the present invention eliminates all of the prior art difficulties by providing a molded plastic base cylinder of substantially the size and shape of the rotogravure cylinder required, which is plated about its entire peripheral surface with either copper or nickel and then etched. In the preferred embodiment, polypropylene is employed as the plastic for the cylinder. In one embodiment, the cylinder is provided with a single bore along the central axis of the cylinder to accommodate the rotation-inducing shaft of the printing apparatus. Another embodiment employs axially extending arcuately disposed fingers or lugs which engage the ends of the cylinder and are mounted to a rotationally driven plate.

By employing a molded plastic base for the rotogravure cylinder of the present invention, a cylinder is commercially obtainable, having perfect balance and perfect concentricity about its central axis. This heretofore unobtainable result is now realized by providing a molded plastic base which comprises both isotonic and isotropic distribution of the plastic throughout the cylindrical base. Since the isotonic and isotropic bases are stress and void free, every point on the outer peripheral surface of the cylinder exhibits precisely identical compression resistant forces.

Since the cylinder base is plastic, the cylinder base of the present invention is easily and economically machined to have an outer peripheral surface which is perfectly concentric with the central axis of the cylinder. This perfect concentricity coupled with a precision balanced driving system, which is also perfectly concentric to the central axis of the cylinder, assures a statically and dynamically balanced rotogravure cylinder capable of performing at high speeds with complete and consistent results for the typical long duration rotogravure runs.

The necessity for having a completely perfectly balanced and concentric rotogravure printing cylinder is clear from the operation of a rotogravure printing system in which it is imperative that the entire etched surface of the rotogravure printing cylinder comes into complete contact with the paper or print medium in order to provide the desired results. Prior art cylinders all have difficulty in this area, generally due to the internal bending of the cylinder against the pressure of the roller or due to imperfect concentricity of the cylinder surface or imperfect balance. This imbalance and imperfect concentricity is then further compounded by the high speed operation of the rotogravure printing system and the heavy weight of these prior art printing cylinders, causing the cylinders to run in continuously increasing elliptical paths due to the unequal centrifugal pull exerted by the heavy weight of the prior art cylinders. Clearly, the inherently balanced cylinder of the present invention eliminates all of these prior art difficulties and provides a unique and operative rotogravure or intaglio printing cylinder.

Furthermore, by employing a molded plastic based cylinder which is plated with the desired metal surface, a rotogravure or intaglio printing cylinder is obtained which is extremely lightweight and easily handled. The molded plastic base cylinder is preferably either driven by a bore through the central axis of the cylinder at a diameter equal to the driving shaft diameter or by end driving plates. In this way, the resulting rotogravure or intaglio printing cylinder, which is obtained after coating and engraving or etching, incorporates a uniform cross-sectional area throughout its length at right angles to the central axis, and a constant uniform material density throughout the entire cylinder, completely stress and void free. Consequently, every point on the outer peripheral surface of the cylinder has exactly the same amount of resistance to buckling or deformation as every other point thereof.

Another advantage of the cylinder of the present invention is its ability to easily withstand the high pressures which result during the printing process without any deformation at any point of the cylinder. This same result is also achieved with an even lighter plastic cylinder by carefully engineering the amount and position of the material removed for the weight relief, while still maintaining the structural integrity of the cylinder itself.

Furthermore, since the rotogravure printing cylinder of the present invention incorporates a base material capable of being manufactured by pouring, casting, or extruding the plastic material in a suitable mold or die, a large variety of different diameters and lengths can be easily obtained. Also, any desired driving shaft size can be accommodated by merely boring the base cylinder to the desired diameter. As a result, all requirements for varying diameters and lengths for any particular printing operation can be achieved quickly and inexpensively.

The gravure plate of the present invention overcomes all of the prior art objections by providing an inexpensive, easily handled, plastic base with an etchable metal surface. Preferably the plastic base is extruded in a single sheet having the desired thickness, plated with an etchable metal, and then cut to the particular size required. In this way, an image ready transfer plate is provided which can be maintained as a stock item, ready for direct engraving or etching of the desired image or information into the etchable metal surface and immediate use of the resulting gravure plate.

Throughout this specification both etching and engraving are used synonymously and interchangeable to represent any method or specific process desired by which the desired image or information is formed in the surface metal of the plates of this invention.

As previously mentioned, the gravure process is capable of achieving color variation by altering both the area of the etching and the depth of the etching. This capability in the gravure process provides superior tonal variation control than is obtainable with raised surface printing wherein only the area can be varied to achieve the tonal variations. As a result, the gravure process is extremely advantageous but heretofore had only been employable for a specific product line because of the expense and difficulty of obtaining and setting a gravure press. With the easily handled, inexpensive gravure cylinders and plates of the present invention, this high-quality printing process can be used in a greater variety of applications wherein the use of the process up until now would not have been feasible.

In addition, by employing the plate of the present invention with a layer of an etchable metal affixed to a nonetchable substrate, heretofore unobtainable control of the etched volume is now achieved. This control is achieved by eliminating the need for a tolerance requirement for exceeding the target depth. With the present invention, excessive etch depth is eliminated, thereby reducing the volume error inherent in prior art plate structures.

A further advantage realized with the plate of the present invention is the elimination of prior art printing difficulties incurred when any foreign matter is present when the plate is mounted for printing. With the plastic substrate of this invention, the foreign matter is harmlessly retained in the plastic without effecting the quality of the print.

The invention accordingly comprises the several steps and the relation of one or more such steps with respect to each of the others, and the articles possessing the features, properties, and relation of elements, which are exemplified in the following detailed disclosure, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
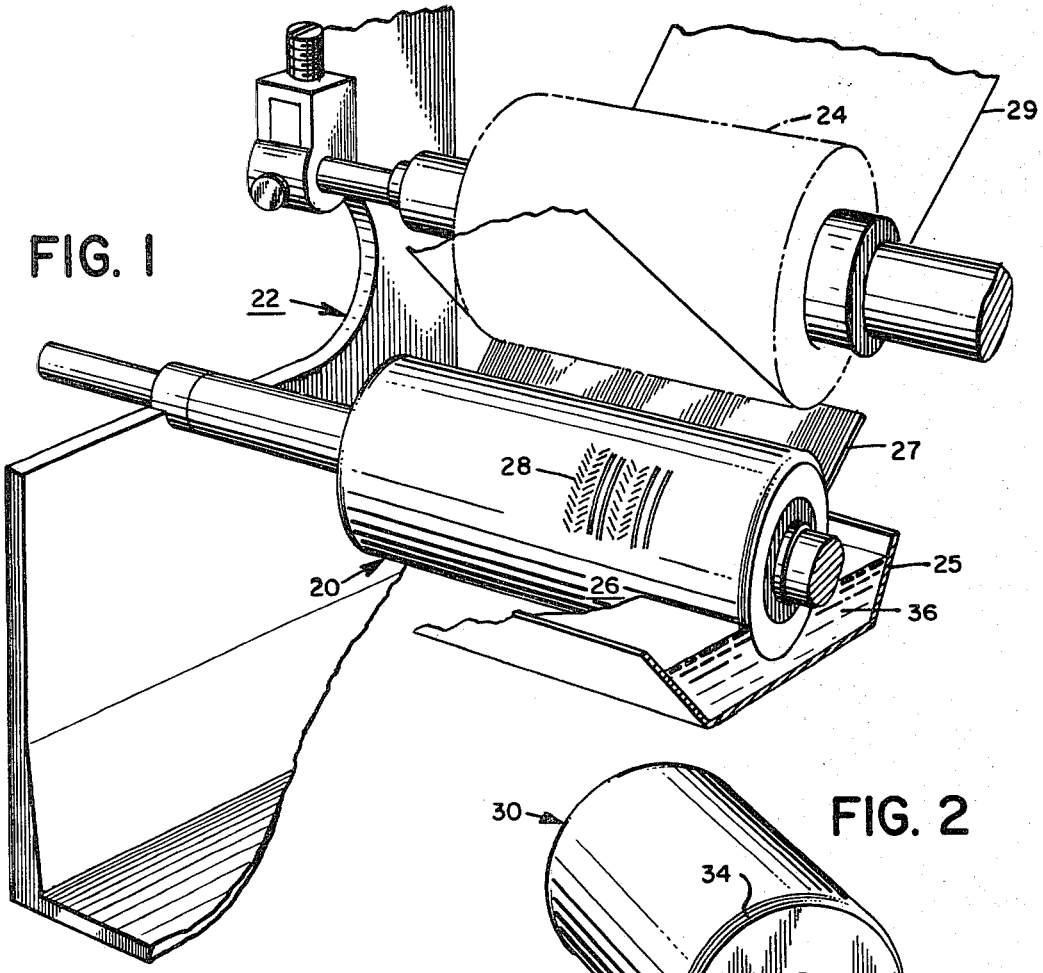
FIG. 1 is a perspective view of a conventional rotogravure printing machine incorporating one embodiment of the rotogravure cylinder of the present invention.

In FIG. 1, the rotogravure cylinder 20 of the present invention is shown mounted on a typical rotogravure printing machine 22. Cylinder 20 incorporates an outer peripheral surface 26 in which a design or image 28 has been etched. Design 28 is etched on surface 26 of cylinder 20 throughout the entire outer peripheral surface thereof, or as otherwise required by the art work. For simplicity, only a portion of design 28 is shown. In juxtaposed spaced relationship to cylinder 20 is impression roller 24 which is in intimate contact with rotogravure cylinder 20 during the printing operation. Cylinder 20 is partially immersed in an ink tray 25 and is in frictionally engagement with a doctor blade 27, which wipes off the excess ink returning this excess to ink tray 25.

The web of substrate or paper 29 to be printed passes between rotogravure cylinder 20 and impression roller 24 and is maintained in firm intimate contact with cylinder 20 by properly adjusting roller 24. As fully described above, the rotogravure printing process is extremely advantageous since the depth of the etching on the surface is controllably varied as well as the area of the etching, in order to control tonal variations of the printed material. As a result, the intimate contact of the substrate or paper 29, upon which the printing is placed, with cylinder 20 is extremely important in order to assure the transfer of all available ink to the printing surface and to achieve the tonal variations obtainable from the cylinder. As a result, impression roller 24 must maintain constant force and pressure on the rotogravure cylinder 20 with printing paper 29 moving therebetween, in order to assure the desired printed result.

In typical rotogravure printing, impression roller 24 maintains a constant force of about 150 pounds per linear inch against the printing cylinder 20. This force is dependent upon the material being printed and may range between about 50 and 300 pounds per linear inch. Impression roller 24 generally comprises a metal tube 60, which incorporates bearings for rotation, with a natural or synthetic rubber or other synthetic material covering 61. The radial thickness of covering 61 generally ranges between $\frac{1}{4}$ of an inch to 1 inch with $\frac{5}{8}$ of an inch being typical. Also, covering 61 has a hardness between 60° and 90°, measured on the Shore A scale, with a Shore hardness of 80° being typical.

Due to the constant, high, equi-distributed, compressive force applied to the cylinder by roller 24, every point on the outer peripheral surface of cylinder 20 must resist this excessive pressure without any buckling or deformation. If the surface of cylinder 20 were to deform under the pressure exerted by impression roller 24, that particular area of the cylinder would not print on the surface of paper 29 as the paper passes across it, and the desired fully printed final product would not be achieved. Also, since rotogravure printing machines generally operate at high speeds with little or no manual control during the operation, it is extremely important that the cylinder functions properly throughout the entire printing operation in order to prevent any misprinted paper which would result in an extremely expensive shutdown and repair.

Cylinder Construction

Figure 2:
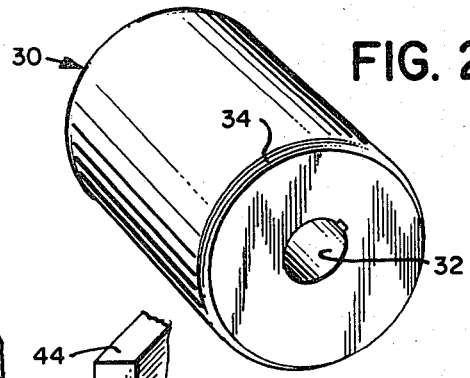
FIG. 2 is a perspective view of one embodiment of the molded base cylinder of the present invention ready for plating and etching.

In FIG. 2, one embodiment of plastic base 30 of this invention is shown prior to plating, with keyway bore 32 incorporated therein extending along the central axis of cylinder 30. In this embodiment, plastic base cylinder 30 is manufactured by casting or pouring polypropylene in a mold of the desired diameter which may incorporate a tapered plug for providing keyway shafting bore 32. Also, the cylinder can be manufactured by extrusion of the plastic through a suitable die.

Since it is important to manufacture a plastic cylindrical base which is both isotonic and isotropic, care must be exercised in producing the plastic base cylinder 30. It has been found that isotonic and isotropic plastic billets, which are both stress and void free, can most economically be manufactured in one of three preferred ways. The first method is in situ in which a mold or suitable cavity is filled with dry resin. Then, the mold and resin unit is slowly brought to the melt temperature and then slowly cooled down. If desired, vacuum may be used in order to remove air bubbles.

The second preferred method is a casting process in which the resin is first pre-melted and degassed in an extruder or similar apparatus, and then the plastic resin melt is poured into a suitable mold or cavity which has been preheated. The entire cavity and resin unit must be insulated and allowed to slowly cool down. Again, vacuum may be desirable in order to remove air bubbles.

The final process in which a suitable plastic base cylinder can be economically produced is through extrusion. In this process, the plastic resin is pre-melted and extruded through a suitable die into an insulated receiver. Then the extruded product must be annealed after cooling in order to release stresses. If care is not exercised both in the cooling process and in the annealing process, shrink voids may form which, of course, would render the cylinder totally ineffective.

After the molding operation, cylinder 30 is removed and trimmed to the exact diameter desired for the cylinder prior to plating. Also, as is more fully described below, it is desirable to form rounded corners 34 at both ends of the cylinder during the trimming operation in order to prevent any plating build-up in these areas.

It has been found that machining the plastic cylinder prior to plating is advantageous for obtaining the precise diameter cylinder required, while also providing an outer peripheral surface which is more receptive of the plating material. This peripheral trimming process is extremely important if agents have been used in the resin mixture, since most addition agents migrate during the manufacture of the plastic part to the outer periphery of the plastic unit. This creates a non-isotonic periphery which will not affect the balance of the cylinder but will affect bonding, since a concentration of agents weakens the outer surface. Consequently, trimming the outer diameter of the cylinder removes the non-isotonic layer and assures a strong bond with the plating metal.

Preferably, a universally applicable base cylinder is formed, without a shaft bore, since the draft bore if so desired can easily be machined during the trimming operation. This procedure is preferred since (1) shaft diameters vary, (2) a precision sized bore can most economically be achieved by boring the shaft-receiving hole after the molding operation; and (3) alternative driving methods may be desired.

In any case, the shafting bore is preferably constructed with a concentricity of ±0.0005 inches. In this way, the requisite balance is achieved.

After extensive research of various plastic materials, it was discovered that polypropylene provided the most unique combination of characteristics for use as the cylinder base. In particular, polypropylene has a low molecular weight, is solvent resistant, has sufficient hardness, is platable, can be easily molded, can be easily machined, is strong and is of relatively low cost. Another plastic material which has been found to also have sufficient combination of characteristics to be usable as the cylinder is polyphenylene sulfide. Other plastics could be employed but are believed to be less desirable.

As is well known in the art, by incorporating fillers into the plastic material during the molding process, additional specific characteristics may be obtained. One of the advantages that can be achieved by employing fillers in the molded plastic material is that the adhesion and platability of the plastic can be enhanced. Also the mechanical properties or physical characteristics of the plastic can also be enhanced. Generally, such fillers as glass, carbon, asbestos, metallic flakes, or silica are employed.

However, the use of fillers is not mandatory for the successful plating of the plastic cylinder of this invention since the entire outer surface of the cylinder is plated. As a result, the use of fillers is not required. In fact, the use of fillers is not suggested for the cylinder of this invention, unless the filler is homogeneously distributed throughout the entire plastic cylinder. This arrangement is preferred, since the plastic cylinder of the present invention can best be utilized by manufacturing a generally required diameter and machining the diameter down to the desired specifications. As a result, if only surface fillers are employed, the effect of the filler will not be obtained if the cylinder diameter is machined below the effective depth of the filler.

However, the use of fillers is more desirable in the construction of the metal-plated, plastic-base printing plate of this invention. In the construction of the plastic base for the plate, surface fillers which promote the adhesion of an etchable metal to its surface may be very useful since adhesion becomes an important factor when encapsulation of the entire plastic base is not anticipated.

As described above, the plastic base cylinder of the present invention is preferably manufactured in a single molding operation as an entire homogeneous cylinder which is then machined to the desired outer diameter and also machined to incorporate the desired driving system, which incorporates, in the two preferred embodiments, a cylindrically shaped, elongated shafting bore along the central axis of the cylinder.

It has been found that the use of either a keyed shafting bore, through which the desired shaft is secured, or end-formed driving lug cavities, provides substantially greater advantages over the typical system of molding metal inserts into the cylinder for use as a shaft. Since plastics are not very compatible with metal inserts and the inclusion of a metal insert for a shaft adds weight and adds to the shipping cost as well as complicating the chemistry of the plating treatment, a shaft-less cylinder is preferred. Furthermore, the incorporation of a shaft into the cylinder itself would require a greater variety of molds than in presently required by merely boring out the shaft hole. Consequently greater flexibility and variety of diameter sizes for various shaft sizes can be achieved with the systems presented in this disclosure.

As discussed above in reference to FIG. 2, one embodiment of the driving system for the rotogravure cylinder of the present invention is the use of the keyway bore 32 through which a cooperating shaft is mounted in order to drive cylinder 20 of the present invention. Although keyway bore 32 is preferred for its simplicity of manufacture and use, various potential problems may develop during its use.

Clearly, the effective operative use of cylinder 20 of the present invention depends upon the successful power transmission from the rotationally inducing drive source to surface 26 of cylinder 20, with sufficient consistency and dependability to overcome the force of the friction drive of impression roller 24 and cause the printing media 29 to be frictionally driven therebetween. Since cylinder 20 is driven along its center line, it is necessary to transmit and distribute the driving forces from the center line of the drive shaft out through base 30 to surface 26 where the rotary shear forces are induced at the interface between cylinder 20 and impression roller 24.

Although the use of a keyway shaft has been successfully employed in driving steel cylinders and is employable with the plastic base 30 of the present invention, it has been found that when the load placed upon surface 26 of cylinder 20 approaches 200 psi, potential driving failure may result. Although no such failure results in a steel cylinder, the shear strength of steel is about 29,000,000 while the shear strength of plastic is about 290,000. Consequently, as the load forces approach 200 psi, the keyway driving shaft will attain a driving force as a moment of torque which could exceed the modulus of elasticity of cylinder 30. Such an occurrence will produce improper driving of cylinder 20, requiring a shutdown of the rotogravure printing system.

Figure 8:
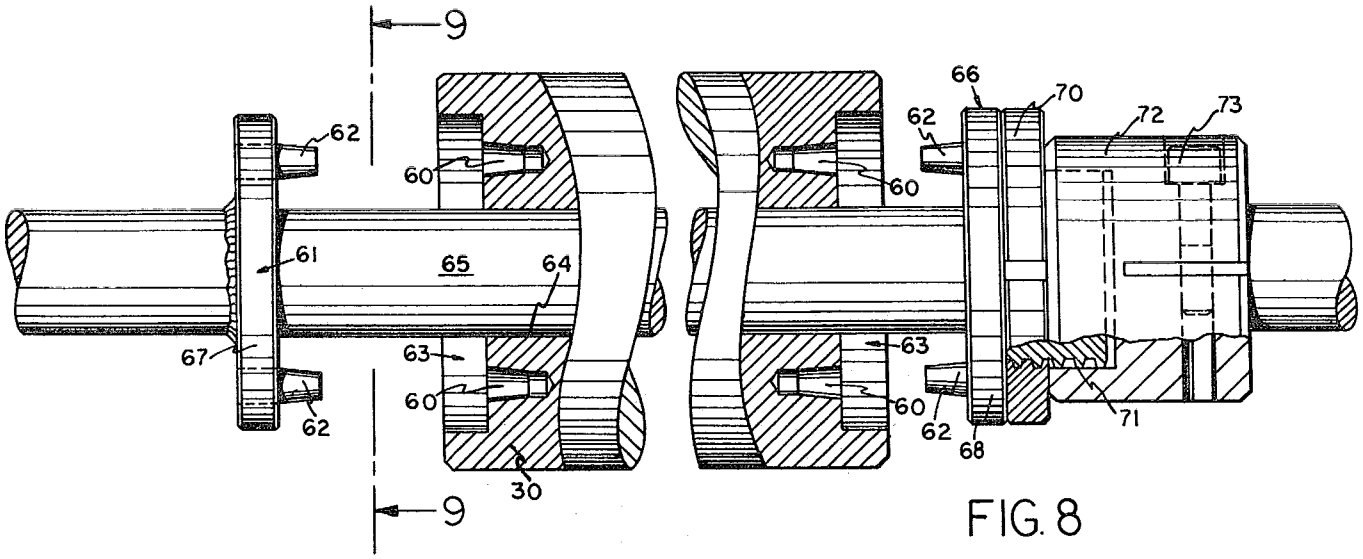
FIG. 8 is a cross-sectional elevation view of a second embodiment of the plastic base rotogravure printing cylinder of the present invention incorporating an alternate driving system.
Figure 9:
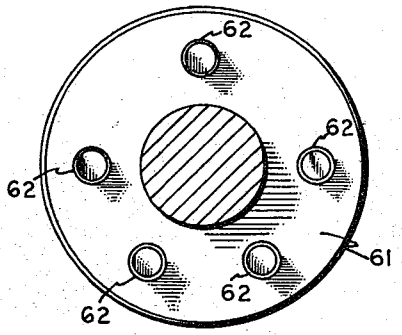
FIG. 9 is a front elevation view of the cylinder driving plate of the driving system of FIG. 8.

In order to overcome potential power transmission problems, an alternative driving system has been developed. This system in its preferred embodiments is shown in FIGS. 8 and 9.

In this embodiment, base 30 incorporates a plurality of lug-receiving cavities 60 formed in both ends of base 30, along with a plate receiving cavity 63 similarly formed on both ends of base 30 and cooperating with lug-receiving cavities 60. The actual number of lug receiving cavities 60 which are formed in base 30 and their precise position depends upon both the design considerations and force requirements to which the cylinder will be exposed. However, each lug-receiving cavity is preferably formed in base 30 at the optimum radial distance from the center line of base 30. The optimum radial spacing for the lug-receiving cavities depends upon many factors such as base material, driving forces required, base diameter, and diameter of alternate bases to be driven by same equipment. With these major factors in mind, the optimum lug cavity position is determined and then formed in the ends of the base with extreme precision.

Base 30 also incorporates an elongated shaft receiving bore 64 extending entirely through base 30. In the preferred embodiment, shaft receiving bore 64 comprises a concentricity of ±0.0005 inches.

This embodiment of the driving system of the present invention is then completed by providing an elongated shaft 65, a fixed driving flange 61, and an adjustably positionable lockable driving flange 66. Shaft 65 is manufactured with concentricity tolerances identical to shaft receiving bore 64 and a diameter to which shafting receiving bore 64 was made. In this way, a rotationally driven shaft is provided along which cylinder 30 can be mounted in order to achieve an intrinsically balanced cylinder construction.

Flange 61 is securely mounted to shaft 65 and incorporates a substantially flat plate member 67 and a plurality of outwardly projecting lugs 62 which are securely journal in or mounted to plate 67. The actual radial position of lug 62 about plate 67 and the arcuate distances between the lugs is a matter of design choice, as discussed above in reference to lug-receiving cavities 62 of base 30. However, a typical lug construction and arrangement is shown in FIG. 9.

Since lug-receiving cavities 60 and plate receiving cavity 63 are constructed to be identically compatible with lugs 62 and plate 67, base 30 when mounted on shaft 65 is moved axially along shaft 65 until each lug 62 is securely positioned within a lug-receiving cavity 60 and plate 67 is securely contained in plate receiving cavity 63 at the first end of base 30.

The driving system is then completed and ready for a successful driving operation by securely positioning adjustably positionable, lockable flange system 66 in position with lugs 62 of plate 68 thereof securely retained in lug-receiving cavities 60 and plate 68 secured in plate receiving cavity 63 at the other end of base 30. Once driving flanges 61 and 66 are securely positioned in their receiving cavities ready for rotationally driving base 30, flange 66 is locked in position, and the rotogravure cylinder of the present invention is ready for operation.

Although a plurality of various systems can be employed to provide an adjustably positionable, lockable flange, one embodiment for this sliding and lockable flange assembly is shown in FIG. 8. In this embodiment, multi-positionable, lockable flange assembly 66 also comprises a locknut 70, a threaded extension member 71, journaled in plate 68 and extending therefrom in a direction opposite from lugs 62, and an adjustable, slidable, collar assembly 72. Collar assembly 72 comprises a split ring, shaft engaging collar and a screw locking means 73 for securely locking collar 72 in any position along shaft 65.

In operation, the sliding and locking flange assembly 66 is secured and locked in any desired position by first adjustably sliding flange assembly 66 along shaft 65 until lugs 62 and plate 68 are securely positioned within their respective cavities. Then, screw means 73 is tightened causing the arms of split ring collar 72 to advance towards each other, and securely and lockingly engage shaft 65. The flange locking is then completed by rotating locknut 70 in the direction causing plate 68 to advance axially into base 30 against locked collar assembly 72, thereby assuring secure receiving cavities.

It is important to note that by employing a plurality of radially positioned lugs which engage plastic base 30 in a plurality of receiving cavities, the surface area employed for driving plastic base 30 is substantially increased to an optimum area which will assure that all driving forces are easily overcome.

In this way, the lower shear strength of plastic base 30 will not in any way affect its performance as an operative rotogravure printing cylinder.

Providing a reliable driving system for the plastic base cylinder of the present invention which assures the cylinder's performance as an operative rotogravure printing cylinder is extremely important, since the plastic base rotogravure printing cylinder of the present invention provides a variety of important benefits heretofore unattainable with prior art systems. The major benefits obtained with the cylinder of the present invention is the attainment of an intrinsically balanced rotogravure cylinder which is both dynamically and statically balanced. Also, the plastic base possesses an inherent quality of self-lubrication, which allows a closely toleranced shaft bore construction while still providing an easily achievable slide fit of the shaft through the cylinder's shaft bore regardless of the length of the cylinder.

Finally, the present invention achieves an image-ready rotogravure cylinder base which can be easily adapted to any printing press journal configuration without any variation in the basic design of the cylinder itself. These extremely important considerations, along with the considerations and advantages stated above, clearly show that the rotogravure printing cylinder of this present invention overcomes the prior art problems, that have heretofore gone totally unresolved, and attains a totally new concept for an operative rotogravure printing cylinder.

Plating

Figure 3:
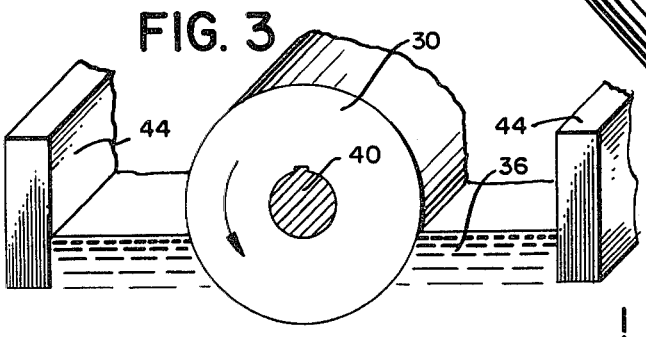
FIG. 3 is a side elevation view of the plastic base cylinder of FIG. 2 mounted for plating, partially submerged in a plating bath.
Figure 6:
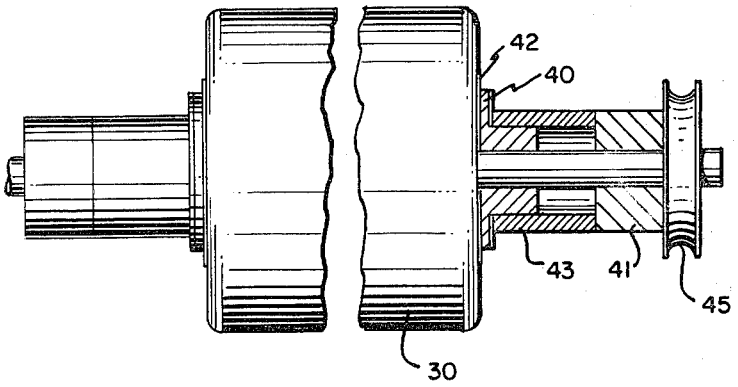
FIG. 6 is a front elevation view of the plastic base cylinder of the present invention similar to FIG. 3, with the cylinder mounted for plating.

Once the base plastic cylinder has been molded, machined to the desired diameter with the shafting bore machined therethrough, the plastic base cylinder is ready for plating. It has been found that a variety of metals can be electrodeposited upon the plastic base cylinder, with copper plating preferred for its low cost and ease of workability. The plating process can best be understood by referring to FIGS. 3 and 6 wherein plastic base cylinder 30 is shown mounted for rotation in electrolyte reservoir 36.

Plastic base cylinder 30 is mounted on a titanium shaft 38 which is connected for rotating plastic base cylinder 30 in electrolyte reservoir 36. In prior art plating processes, current conduction presented no difficulty since the base material was metallic. However, in the present invention, the use of plastic base cylinder 30 presents additional problems since the plastic is in of itself non-conductive.

As a result, current connections are made by employing bronze or brass sleeves 40 on titanium shaft 38 along with copper endplates 42 mounted at both ends of base cylinder 30. In this way, the titanium shaft picks up the current through brass sleeve 40. Also, a brass ring 41 is employed near the end of shaft 38 to pick up the cathode current and a non-conductive spacer 43 is employed between brass rings 40 and 41 in order to maintain the desired spacing therebetween.

The preferred anode employed are bar copper anodes 44 which are located parallel to the face of base cylinder 30. It has been found that the best plating is attained by employing anodes parallel and equidistant to the axis of the cylinder. During the plating operation, base cylinder 30 is rotated by means of the titanium shaft 38 which can be controlled by any suitable variable speed motor drive through drive connection 45.

The electrolyte tank in which electrolyte 36 is contained may be independent of base cylinder 30, titanium shaft 38, and the various driving and current conducting equipment. In this way, the tank can be mounted on a lifting device which allows the tank and its contained electrolyte to be raised up to base cylinder 30 in order to permit immersion of base cylinder 30 up to 50% or more of its diameter during the electro-depositing process. Although this arrangement is not required, the flexibility achieved has been found to be advantageous.

Figure 4:
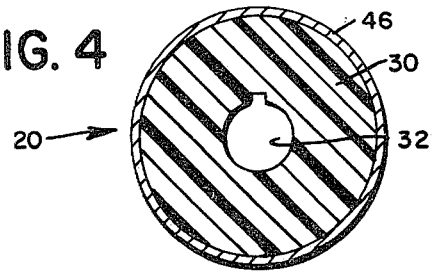
FIG. 4 is a cross-sectional side elevation view of one embodiment of the rotogravure printing cylinder of the present invention taken along line 4—4 of FIG. 5.

After the metal has been deposited onto plastic base cylinder 30 in a sufficient amount to achieve the desired diameter, the metal plated plastic base cylinder is removed from the plating tank. As shown in FIG. 4, after electrodeposition of the metal peripheral surface, intaglio printing cylinder 20 comprises a cylinder incorporating a shafting bore 32, a plastic base cylinder 30 and an outer peripheral metal deposited coating 46, which encapsulates the plastic base and is ready for final polishing and etching. Preferably, metal-plated coating 46 is of a sufficient depth to exceed the exact outer diameter requirement for the rotogravure or intaglio printing cylinder. As a result, cylinder 20 is then polished to impart the desired surface characteristics to metal plating 46 while also achieving the precise diameter desired in the particular rotogravure printing system. After the polishing operation, cylinder 20 which is at this time an image transfer ready cylinder is then sent for etching of the particular information on to metal-plated surface 46 in order to impart the particular printing information to cylinder 20.

In the preferred embodiment, the etchable metal coating comprises a thickness of at least 0.010 inches and no greater than 0.040 inches. Furthermore, the metal surface should have a hardness of at least 140 Vickers when measured on the Vickers Scale.

In order to plate the surface of the cylinder of this invention with an etchable metal, a variety of plating processes can be employed. Many techniques have been tested and each have been found to produce a plated cylinder capable of being polished and etched to form the metal plated plastic base intaglio printing cylinder of this invention.

Basically, the plating processes comprise first conditioning the peripheral surface of the plastic cylinder with various conditioning agents in order to establish a surface which is readily receptive of the metal being electrodeposited. Once the surface is properly conditioned, the cylinder is placed in an electroless plating bath in order to deposit a thin coating of the etchable metal on the surface of the cylinder. This electroless plating, if employed, renders the previously non-conductive surface conductive. Then, the cylinder is mounted as described above in the electrolyte reservoir and rotated while the etchable metal is plated about the entire exposed surface of the plastic base cylinder. Once the desired thickness of metal has been deposited onto the surface of the plastic base, the metal plated plastic base cylinder is polished to the exact diameter desired for the particular rotogravure process, and the image transfer ready cylinder is then engraved or etched with the desired image or information, and is then ready for use in the printing equipment.

Although a variety of plating techniques can be employed, it has been found that plastic treatment followed by an electroless plating exposure and then electrodeposition of copper, provides the most economical plating technique. The outer surface of the plastic base is first treated with a conditioning solution which develops sites on the plastic surface where bonds between the plastic and the copper deposit may be established. The conditioning agent also renders the plastic surface wettable by the subsequent electroless copper solution.

After the application of the conditioning solution, the surface is treated with an acid bath and then further treated with additional surface preparation solutions. These additional solutions further enhances the plastic surface for the subsequent plating by making the surface more receptable to the formation of an adherent, fine-grain metallic deposit. If desired, the surface can be treated with a solution which deposits a thin metallic film on the surface of the plastic in order to further promote the deposition of the desired adherent, fine-grain, metal deposit.

Next, the cylinder is placed in an electroless copper bath to establish a thin copper coating on the cylinder surface. In this way, the previously non-conductive surface becomes conductive.

Once the surface of the plastic base cylinder has been properly treated and coated, the cylinder is mounted in a copper electro-plating bath and rotated, as described above, until the desired thickness of copper has been deposited on the entire exposed surface of the plastic base cylinder. The copper surface is then treated in a manner well known in the art in order to provide a clean, bright copper surface ready for polishing and etching.

A firm, tightly engaging bond between the plastic base and metallic plate is not required, as has been generally taught in prior art references. However, due to the different thermal expansion properties inherent in the plastic base and the metallic coating, some degree of adhesion between the interfacing, contacting surfaces of these materials is preferred in order to prevent unwanted detachment.

According to resin manufacturers, the typical plastic polymer for the cylindrical base of the present invention has a thermal expansion co-efficient of "6" at 25° C.–100° C. and, according to the Handbook of Chemistry and Physics, copper has a thermal expansion co-efficient of "16.8" at 25° C.–100° C. Under these conditions, an adhesion of 9.6 pounds per inch has been found to be sufficient to permit normal thermal cycling without any detachment problems. This normal thermal cycling includes temperature changes through all stages of manufacture, elevated warehouse temperatures encountered during storage, and temperature rises encountered in the printing press due to friction or contact with a hot substrate. Although 9.6 pounds per inch has been found to be preferred, at similar adhesion would be within the scope of this disclosure, as well as vastly different adhesion rates, when alternative materials or conditions are employed.

One example of a plating process for the electrodeposition of copper, which has been found to provide an extremely strong and adherent copper surface on the plastic base of this invention, is described below in detail. The surface conditioning, surface preparation, and plating solutions defined in this particular process are identified by trade names employed by Enthone, Incorporated of West Haven, Conn. The solutions defined are all readily available in the industry and are used in this disclosure as examples of the types of solutions and electrolytes which can be employed in the plating process.

The first step in the process is to treat the surface of the plastic base cylinder of the present invention with Enplate Conditioner 474 at 150° F. for 20 minutes. This is then followed by a water rinse. The second step is to additionally treat the surface of the plastic base cylinder of this invention with 20% hydrochloric acid (by volume) for one minute followed by a water rinse. Then the plastic base cylinder is treated with Enplate Sensitizer 432 for one minute, water rinsed, and then treated with Enplate Activator 440 for one minute followed by a water rinse. The plastic base cylinder is then placed in the electroless plating bath which contains Enplate electroless Copper Cu-404 and maintained in this bath for 15 minutes and then water rinsed. Then, the cylinder is placed in sulfuric acid, 5 percent by volume, for one minute and water rinsed.

The fully treated and coated cylinder is then mounted on a titanium shaft and secured on the shaft in position with the various collars and associated conductive material mounted on the shaft on both ends of the cylinder, as fully described above. The entire assembly is then secured for rotation in the electrolyte tank which contains Enthobrite CU-942. The cylinder is rotated in the copper electrolyte until the desired thickness of copper is built-up on the exposed cylinder surface. Generally, a surface coating of about 0.015 inches is desirable.

The resulting copper plated plastic based cylinder is then water rinsed, dried, and treated in the manner well known in the art for providing the copper plate with the desired finished qualities. Once the copper plated plastic based cylinder is polished, the image transfer ready cylinder of this invention is completed, ready for etching or engraving in the conventional manner to produce the rotogravure printing cylinder of this invention.

Alternate plating processes which can be employed in order to provide the plastic base cylinder with an etchable metal surface can be found in the following references:

Metallic Coating of Plastics, Vol. 2 William Goldy, Chapter 26, pages 359–374.

Principles of Electroplating and Electroforming, 3rd edition, Blum and Hogaboom, Chap. VIII, pages 220–235.

Canning Handbook On Electroplating, 21st edition, Chapter 27, pages 683–694.

Figure 5:
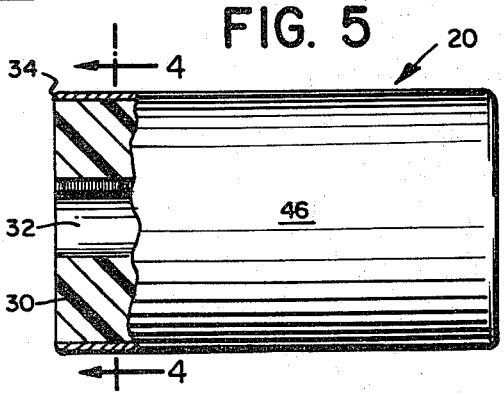
FIG. 5 is a front elevation view partially in cross-section of one embodiment of the image transfer ready cylinder of the present invention wherein the keyway shafting bore can best be seen.

As shown in FIG. 2 and referred to above, the incorporation of rounded edges 34 in plastic base cylinder 30 assures that any build-up of electrodeposited coating 46 on base cylinder 30 at these corners will not exceed the overall diameter of printing cylinder 20, as shown in FIG. 5. It has been found that if rounded corners 34 have not been incorporated in the base cylinder 30, additional build up of electrodeposited material 46 will result at the corner and thereby produce additional post-plate machining to avoid undesirable degradation of the doctor blade during the printing and inking operation. However, it is important to note that rounded corners 34 must be employed in combination with proper anode arrangement in order to assure that no undesirable plating buildup occurs at the corners. Furthermore, current density shields, well known in the art, can also be employed to control the metal buildup at the corners.

Cylinder Advantages

The attainment of an operative rotogravure printing cylinder having a gravure metallic surface totally supported by a plastic base possesses numerous advantages over prior art cylinders, many of which have been discussed throughout this Application. The major advantages achieved by the present invention are (1) a substantial reduction in weight, (2) perfect intrinsically obtained balance, both dynamically and statically, (3) repeatable economic manufacturability of support base with isotonic and isotropic qualities, (4) handling ease, (5) maintenance of precision-level tolerances with ease and reproducibility, (6) self-lubricating qualities for slidability of precision-made shaft through shaft bore regardless of length of cylinder, (7) deflection resistance, and (8) adaptability to any printing press configuration without modification of basic cylinder design.

These features are then enhanced and made realistic by providing the rotogravure printing cylinder of the present invention with a driving system capable of delivering these unique advantageous qualities to a printing press. The combination of the plastic base cylinder and the proper driving system assures rotational driving of the plastic base rotogravure printing cylinder of this invention in a rotogravure printing press with all of the pressures, frictional forces, and long running operational requirements being attained and all of the prior art difficulties eliminated.

Among the most important physical characteristics obtained by the cylindrical plastic supporting base of this invention are its isotonic and isotropic qualities. By achieving a supporting base which is reproduceably and economically manufactured with stress and void-free characteristics in combination with complete, total homogeneity of the support material throughout the entire cylindrical base, the plastic supporting base of this invention establishes an intrinsically balanced cylinder, which realizes deflection-free operation under the pressure loads encountered in rotogravure printing.

As shown in FIGS. 5 and 8, both embodiments of the intaglio and rotogravure printing cylinder 20 incorporates a precision made shaft bore, which extends axially along the entire length of printing cylinder 20. In this way, each and every vertical cross-section of the cylinder 20 which is taken perpendicularly through the shafting bore will result in identical cross-sectional areas, since the entire printing cylinder 20 is isotropic, comprising an identical composition density throughout its entire length. Also, cylinder 20 is isotonic, being completely stress and void-free. Consequently, the pressure applied to cylinder 20 during the printing operation will have identical resisting forces at every point on the outer peripheral surface of cylinder 20. In this way, any areas which may otherwise result in buckling or forced deformation during the printing operation are completely eliminated.

Consequently, cylinder 20 comprises a printing cylinder capable of thoroughly and completely resisting all of the compressive forces placed thereon during the printing operation without any deformation or buckling of the printing surface. This "built-in" force resistance of cylinder 20 is extremely important in assuring that the superior advantages of rotogravure printing such as tonal variation control, high production, long continuous operation, and infinitely variable repeat information, can be achieved with the inexpensive, easily-handled cylinder of this invention. Obviously, this achievement provides a more desirable print quality, imparts greater confidence in the printing cylinder for constant and consistent printing results throughout the entire length of the run, and allows other heretofore unthought-of printed product lines to employ the rotogravure cylinder of this invention at an economical cost.

Since rotogravure printing, as discussed above, employs a series of rollers all rotating at high speeds, dynamic and static balance of the printing cylinder is extremely important in order to assure normal production rates as well as maintain the required close register and reduce machine and cylinder wear. By providing an isotonic plastic supporting cylindrical base, having a shaft receiving bore which is toleranced to ±0.0005 inches to the center line of the cylinder, the cylindrical plastic supporting base is intrinsically balanced and capable of meeting all of the operational requirements of the rotogravure printing press. This achievement provides a new concept, completely divergent from the classic tubes and gudgeons employed in rotogravure printing systems which are intrinsically unbalanced.

By referring to various well established formulas for balance and deflection, the attainment of an intrinsically balanced, deflection resistant, plastic base rotogravure printing cylinder is better understood from a theoretical basis. In the basic formula for determining the sensitivity of a balance, assuming the three knife edges of a balance lie on a straight line, the deflection theta ($\theta$) produced by any imbalance is represented by:

$$\tan \text{THETA} = mL/Mh$$

In this formula, M is the weight of the beam, h is the distance of the center of gravity or balance point below the knife edge (in this case the center line of the shaft to the center of gravity, m is the small mass or amount of imbalance, and L is the length of the beam).

From this formula, it can be seen that when an intrinsically balanced cylinder, which possesses a low modulus of elasticity, is compared to an intrinsically unbalanced cylinder of a high modulus of elasticity under identical conditions of loading and rotation, the dynamic sum of deflection will be less in the balanced cylinder than in the unbalanced cylinder.

The next critical calculation important for rotogravure cylinders is a measurement of its actual deflection. Rotogravure cylinder bases are generally manufactured to performance specifications based on the classic formula for calculating deflection in a simple beam, uniformly loaded. This formula is as follows:

$$\text{MAX DEFLECTION} = \frac{5wl^4}{384EI},$$

where w = wt. load/unit length
l = length of cylinder
E = Modulus of elasticity
I = Moment of Inertia Also, in order to obtain the maximum impression for the maximum deflection, the following formula is employed:

$$\text{DELTA MAX} = \frac{M.\ Defl.\ (384)\ (Mod\ Elas)\ (1)}{5(1) \text{ to 4th Power}}$$

As shown in these formulas, maximum deflection is directly proportional to the weight of the cylindrical base. Consequently, the substantial reduction of the weight of a rotogravure cylinder, which is achieved with the plastic base rotogravure printing cylinder of this invention, produces a substantial reduction of the maximum deflection.

The other important variable in this formula is the modulus of elasticity, since the modulus of elasticity of the plastic base is about 1/10 of the modulus of elasticity of a steel base. It has been found that by providing the isotonically distributed cylindrical plastic base of this invention with its stress and void-free characteristics with a modulus of elasticity of at least 250,000 psi, the plastic base rotogravure printing cylinder of this invention will perform as a rotogravure cylinder wherein maximum deflection under dynamic conditions will not result in loss of print quality due to unequal pressures. The achievement of this result is also dependent upon the shaft bore having a concentricity of ±0.0005 inches to the outer circumference for a slide fit of the steel shaft, which is typically and preferably fabricated from A1S1 C1045 hot rolled carbon steel or grade with similar properties, with the plastic base cylinder having electrodeposited circumferential shell of copper with a thickness of between 0.010 inches and 0.040 inches and a hardness of 140 Vickers measured on the Vickers scale. Under these preferred conditions, the plastic based rotogravure cylinder of this invention provides a rotogravure cylinder capable of achieving the operative standards placed upon rotogravure printing systems regardless of the force requirements and pressure demands of the rotogravure printing press.

Plate Construction and Advantages

For simplicity of disclosure, the foregoing description has concentrated on the rotogravure cylinder of this invention, since the construction and operation of the cylinder presents various unique and complex problems. However, many details contained in the foregoing description apply equally to the gravure plate construction of this invention and, although the cylinder is specifically mentioned, the substance of the foregoing disclosure should be interpreted as also applying to the plate construction of this invention where such interpretation is realistically applicable.

Figure 7:
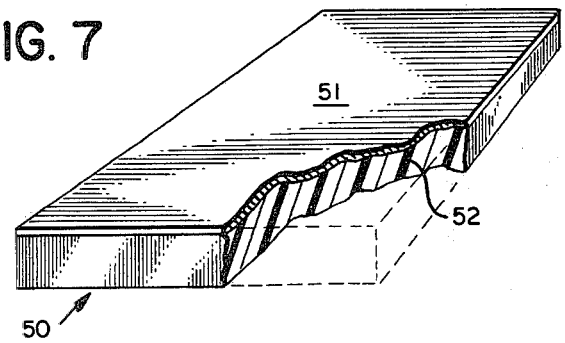
FIG. 7 is a perspective view partially in cross-section of the gravure or intaglio plate of the present invention.

In FIG. 7, a gravure or intaglio plate image ready transfer 50 of this invention is shown with an etchable metal surface 51 mounted to plastic base 52. As detailed above, although various etchable metals may be employed, it has been found that copper plating is best for economy and workability. Plastic base 52 may comprise various plastics, however, polypropylene has been found to be best suited for use as the base plastic. One of the major advantages of polypropylene, which is particularly significant with the use of plate 50, is the resistance polypropylene has to the degrading action of the inks employed in the printing process. Since metal surface 51 is preferably secured to only the top surface of base 52, the ink may well come into contact with plastic base 52 about the edges thereof. As a result, the use of a plastic, such as polypropylene, which has a physical characteristic extremely resistant to degradation by the ink, is an extremely significant factor which must be considered when selecting the particular plastic base.

Plastic base 52 may be formed in a variety of plastic forming processes. However, it has been found that the formation of plastic base 52 by extrusion provides the most economical manufacturing method. Once the extruded elongated piece of plastic has been formed, the plastic base is plated with the etchable metal, cut to the desired size, and surface finished if required.

Having obtained plastic base 52, the etchable metal is then secured to the top surface of plastic base 52. Again, various methods of depositing or securing etchable metal 51 to plastic base 52 are possible. Basically, the various processes can be divided into two most distinct techniques. One technique would be to electrodeposit a film of copper, or other etchable metal, onto the surface of plastic base 52, using a process similar to that detailed above. The other technique would be to employ a preformed sheet of copper, or other suitable etchable metal which is cut to a desired size, and intimately bond the copper sheet to plastic base 52.

Although either of these two basic approaches can be employed to obtain the gravure plate of this invention, it is believed that the deposition of the etchable metal on the plastic base provides the best method for achieving a secure intimate bond between etchable metal 51 and plastic base 52 which will resist all of the forces and corrosive climate to which the gravure plate will be subjected.

Once etchable metal surface 51 has been intimately secured to plastic base 52, the metal surface is then polished in order to provide the surface with the desired surface characteristics. Then, as described above, the particular image or information to be printed is directly engraved or etched into metal plate 51 in order to provide a gravure plate ready for operation.

In one embodiment, the gravure plate of this invention is covered with photo-resist after the plating and polishing operation. In this way, image ready transfer plate 50 will be responsive to ultraviolet light, upon exposure, in order to quickly and easily produce a gravure plate having the desired information or image therein. If desired, the photoresist can be eliminated in order to provide image ready transfer plate 50 which is ready for direct etching or engraving, by other processes, whenever so required by the user.

As previously discussed, gravure plates presently employed in the industry do not have the flexibility and inexpensive characteristics which are inherent in the gravure plate of the present invention. Because of the extremely high cost in manufacturing and producing the present day gravure plate, no such plate is capable of being maintained as a stock item and must be specially ordered for specific product lines. By employing the gravure plate of the present invention, an inexpensive, easily handled, readily available gravure plate is achieved which can be maintained as a stock item in a plurality of sizes. By having the metal plated plastic base plate of this invention an image transfer ready plate can be stocked and directly etched or engraved when its use is required, in order to quickly and efficiently attain the gravure plate needed for immediate production. In this way, greater flexibility and usability of gravure plates can be attained and the quality of work inherent in the gravure process can be expanded into areas where the use of this quality process has never been economically feasible.

By employing the gravure plate of the present invention, additional prior art difficulties are eliminated and an improved product is achieved. In particular, one major advantage achieved with the gravure plate of the present invention is a substantial increase of control over the maximum and minimum etched volume that may be realized due to tolerances within which prior art systems must work.

Figure 7A:
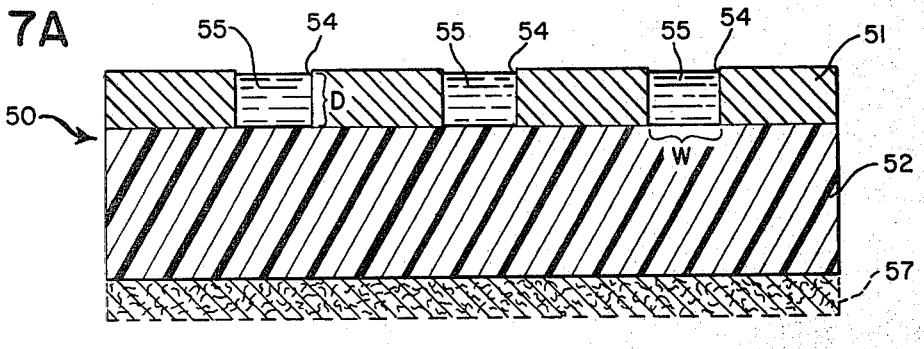
FIG. 7A is an enlarged, cross-sectional side elevation view of the gravure or intaglio plate of FIG. 7 shown with etched areas.

It has been found by electrodepositing or laminating a layer of an etchable metal to the nonetchable substrate as taught by this invention, it is now possible to greatly control the volume of any resultant three dimensional intaglio etched geometric shape. As shown in FIG. 7A, a particular etched geometric shape 54 has a maximum depth of "D". By employing nonetchable substrate 52, the maximum depth that the etch can take is controlled by the thickness of etchable metal surface 51. As a result, the prior art plus and minus depth tolerances are controlled by setting the nominal depth dimension to be equivalent to the thickness of etchable metal surface 51. In this way, only the "minus" tolerance is possible, while the "plus" tolerance is eliminated.

In order to best understand the increased control achievable with the plate of the present invention, the actual volume variation for a three dimensional intaglio etched geometric shape in the plate of the present invention must be compared to the prior art plates. The volume variation within acceptable tolerances for any etched geometric shape is best expressed as a percent of the target volume. Mathematically, this would be expressed by the following formula:

$$\% \text{ Variation} = \frac{\text{Max Volume} - \text{Min Volume}}{\text{Target Volume}}$$

Using this formula, the improved volume control obtained with the plate of the present invention is evident in the following example.

EXAMPLE

Assume:

(1) the etched geometric shape is a regular cube,
(2) tolerances are ±5 microns,
(3) L=W=150 microns, and
(4) D=40 microns $$\text{Target Volume} = (150)(150)(40) = 900{,}000 \text{ cubic microns}$$

$$\% \text{ Variation (Prior Art)} = \frac{[(L+5)(W+5)(D+5)] - [(L-5)(W-5)(D-5)]}{(L)(W)(D)}$$

$$\% \text{ Variation (Inventive Plate)} = \frac{[(L+5)(W+5)(D)] - [(L-5)(W-5)(D-5)]}{(L)(W)(D)}$$

Prior Art Plate - (All Etchable)

$$\text{Max Volume} = (155)(155)(45) = 1{,}081{,}125 \text{ cubic microns}$$

$$\text{Min Volume} = (145)(145)(35) = 735{,}875 \text{ cubic microns}$$

$$\% \text{ Variation} = \frac{1{,}081{,}125 - 735{,}875}{900{,}000} = 38.4\%$$

Inventive Plate (Etchable Metal With Non-Etchable Substrate)

$$\text{Max Volume} = (155)(155)(40) = 961{,}000 \text{ cubic microns}$$

$$\text{Min Volume} = (145)(145)(35) = 735{,}875 \text{ cubic microns}$$

$$\% \text{ Variation} = \frac{961{,}000 - 735{,}875}{900{,}000} = 25\%$$

As is readily apparent from the foregoing, the ability to prevent exceeding target volume provides an increase of over 13% in the control of the actual three dimensional intaglio etched geometric shape. This control is extremely important since the gravure or intaglio process employs fluid inks which must be continuously adjusted to compensate for variations in the unit volume of the etch.

An additional advantage realized with the plates of the present invention is the ability to prevent the inclusion of foreign matter, such as dirt or hair, from disturbing the image area. One of the major problems presently encountered in prior art gravure plates is the effect that foreign matter such as dirt and hair has on the final image when this foreign matter is retained between the lower surface of the plate and the mounting surface on which the plate is secured.

As discussed above, the nature of the intaglio printing process employs images which lie below the surface of the printing plate. This construction is best seen in FIG. 7A, were etchable metal surface 51 incorporates an etched geometric shape 54 formed therein and in which ink 55 is retained. When the image is to be placed on the particular medium, ink 55 is transferred from etched shape 54 to the print medium.

In order to maintain the quality of image desired and achievable with gravure or intaglio printing, a wiping mechanism is incorporated into the system to remove excess ink from the top of metal surface 51 without disturbing the image area. However, if foreign matter is retained below the plate, the plate will not be precisely positioned and the wiping mechanism will be forced to bridge any raised high spot, resulting in the ink not being wiped away from around the area above the intrapped matter. This failure to remove the ink causes the image to be effected in an undesirable manner.

By employing the plate of the present invention, the difficulty encountered with foreign matter retained between the mounting surfaces is completely eliminated. Since the plate of the present invention employs a plastic substrate 52, any foreign matter causes the relatively soft plastic material to be slightly deformed in the area of contact only, without in any way effecting the pitch or angle of the plate itself. Consequenly, the surface of plate 50 will always be maintained in the precise accurate position without the possible presence of foreign matter producing any negative image effects.

If desired, an additional layer of an absorbent backing can be employed on the bottom surface of plate 50. This embodiment is shown in FIG. 7A by absorbent backing material 57 mounted to plastic substrate 52. Of course, if desired the absorbent backing material 57 could also be employed on prior art metal plates, thereby eliminating the difficulty presently encountered with foreign matter.

It will thus be seen that the objects set forth above, among those made apparent from the preceding description, are efficiently attained and, since certain changes may be made in carrying out the above process and in the construction set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. Gravure printing apparatus comprising:

A. a pre-formed substantially solid, rigid and compression resistant supporting base plate of substantially uniform thickness consisting essentially of homogeneous, stress free plastic material with at least one completely smooth, impression-free surface;

B. A homogeneous etchable metal layer of uniform thickness affixed solely to the smooth surface of said supporting base; and C. printing information etched into said metal surface.

2. Image ready gravure printing apparatus comprising:

A. a pre-formed substantially solid, rigid and compression resistant supporting base plate of substantially uniform thickness (a) consisting essentially of stress free plastic material homogeneously disposed throughout said base; and (b) having a substantially completely smooth, impression-fee surface; and B. an etchable metal layer of uniform thickness affixed to the smooth surface of said supporting base plate, whereby said image ready apparatus can be maintained as a stock item, ready for imaging and etching.

3. A gravure printing plate comprising:

A. a substantially solid, rigid and compression resistant flat supporting base plate of substantially uniform thickness consisting essentially of a nonetchable homogeneous, stress free, plastic material with at least one substantially completely smooth, impression-free surface;

B. an etchable metal plate of uniform thickness affixed solely to the smooth surface of said plastic base plate; and C. printing information etched into said metal.

4. The gravure printing plate defined in claim 3, wherein said plastic base plate incorporates filler material homogeneously disposed throughout said plastic to enhance physical characteristics of said plastic.

5. The gravure printing plate defined in claims 1, 2 or 3, wherein the plate further comprises D. a soft, resilient layer of compressible material affixed to the mounting surface of the flat supporting base which is opposed from the surface of the base to which the etchable metal is affixed, thereby providing a gravure printing plate wherein particulate material entrapped between the mounting surface of the plate and the printing equipment will not adversely affect the print quality of the plate.

6. A gravure printing plate having over the etch volume, a greatly enhanced control comprising:

A. a substantially solid, rigid and compression resistant flat supporting base plate of substantially uniform thickness consisting essentially of a nonetchable, homogeneous, stress free, plastic material having (a) a top surface which is substantially completely smooth and impression-free, and (b) a bottom, mounting surface comprising a yieldable plastic material adapted for receiving deformation upon contact with any foreign material when entrapped between said surface and any surface to which the surface is affixed; and B. an etchable metal plate (a) affixed solely to the top surface of said plastic base, and (b) comprising a uniform thickness which is substantially equivalent to the desired, nominal etch depth for gravure printing information; and (C) gravure printing information etched into said metal with enhanced etch volume control since the nominal etch depth for most of said information is incapable of being exceeded.

7. The gravure printing plate defined in claims 1, 2, 3, or 6, wherein said plastic base plate comprises one selected from the group consisting of polypropylene and polyphenylene sulfide.

8. The gravure printing plate defined in claims 1, 2, 3, or 6, wherein the etchable metal plate is further defined as comprising a thickness which is substantially equivalent to the nominal target depth for the printing information to be etched therein, thereby providing a gravure printing plate wherein the nominal etched depth is also equivalent to the maximum etched depth regardless of the etching tolerances, achieving greater control of etched volume.

9. The gravure printing plate defined in claim 6, wherein said bottom surface comprises a separate layer of plastic material which is easily deformable and yieldable upon contact with particulate material.

10. A process for manufacturing gravure printing apparatus comprising the steps of:

A. forming a supporting plastic base of substantially solid, rigid, compression resistant, homogeneous and stress free material of uniform thickness;

B. affixing an etchable metal layer of uniform thickness to at least one surface of said plastic base; and C. transferring the desired gravure image into said metal.

11. A process for manufacturing an image ready transfer gravure plate comprising the steps of:

A. forming an elongated plastic supporting base of substantially solid, rigid, compression resistant, homogeneous and stress free material of uniform thickness;

B. affixing an etchable metal layer of uniform thickness onto at least one surface of said plastic base; and C. trimming said metal-coated plastic base to a desired size.

12. The process defined in claim 11, wherein said etchable metal is affixed to said plastic base by electrodeposition.

13. The process defined in claim 11, wherein said etchable metal is affixed to said plastic base by bonding a thin sheet of an etchable metal to said plastic base.

14. The process in claim 11, comprising the additional step of:

D. applying a photo-resist to said metal surface, thereby providing an image-ready transfer plate which is maintainable as a stock item ready for receipt of the desired image.

15. The new use of a plastic base printing plate as a gravure plate comprising the steps of:

A. forming a supporting plastic base of substantially solid, rigid, compression resistant, homogeneous and stress free material of uniform thickness;

B. affixing an etchable metal layer of uniform thickness to at least one surface of said plastic base; and C. transferring the desired gravure image onto said metal.

16. The process defined in claim 10, 11 or 15, further defined in that said supporting base is formed by an extruding step following by a slow cooling step to provide an isotonic isotropic homogeneous base.

17. The process defined in claim 16 wherein said plastic base is formed of polypropylene.

18. The process defined in claims 10, 11 or 15, wherein said plastic base is formed of a plastic material inert to gravure inks.

19. The process defined in claim 18 wherein said plastic base is polypropylene.

* * * * *